US005402658A

United States Patent [19]

Strahm

[11] Patent Number: 5,402,658

[45] Date of Patent: Apr. 4, 1995

[54] APPARATUS FOR THE WET TREATMENT OF TEXTILE TUBULAR FABRIC

[75] Inventor: Christian Strahm, Bronschhofen, Switzerland

[73] Assignee: Solipat AG, Zug, Switzerland

[21] Appl. No.: 181,074

[22] Filed: Jan. 14, 1994

Related U.S. Application Data

[62] Division of Ser. No. 947,697, Sep. 21, 1992, Pat. No. 5,311,626.

[30] Foreign Application Priority Data

Sep. 23, 1991 [CH] Switzerland ..... 2812/91

[51] Int. Cl.[6] ..... D06B 21/00

[52] U.S. Cl. ..... 68/9; 68/13 R; 68/22 R

[58] Field of Search ..... 8/149.1, 151; 68/5 D, 68/5 E, 9, 13 R, 22 R, 62, 183

[56] References Cited

U.S. PATENT DOCUMENTS

| | | | |
|---|---|---|---|
| 3,074,261 | 1/1963 | Wilcox | 68/5 D |
| 4,166,367 | 9/1979 | Sando et al. | 68/9 |
| 4,182,140 | 1/1980 | Sando et al. | 68/13 X |
| 4,313,235 | 2/1982 | Gotovtseva et al. | 8/149.1 |
| 4,835,992 | 6/1989 | Koch | 68/13 |
| 4,843,669 | 7/1989 | Koch et al. | 68/13 X |

*Primary Examiner*—Philip R. Coe
*Attorney, Agent, or Firm*—Fisher & Associates

[57] ABSTRACT

The fabric (1), which is pre-treated wet and is supplied in strand form, is inflated to form a balloon (15, 15', 15'', 15''') by means of a gaseous medium, is then combined again to form a strand and in strand form is guided through an overflow pipe (17, 17', 17'', 17'''). Subsequently, these process steps are repeated a plurality of times in analogous sequence.

4 Claims, 3 Drawing Sheets

APPARATUS FOR THE WET TREATMENT OF TEXTILE TUBULAR FABRIC

This application is a division of U.S. patent application Ser. No. 07/947,697, filed Sep. 21, 1992, and now U.S. Pat. No. 5,311,626.

The invention relates to a process for the continuous wet treatment of textile tubular fabric, to an apparatus for carrying out this process and to the use of this process.

The object of the present invention is in particular to provide a process which requires significantly less water, chemicals and energy than processes known hitherto to achieve the same wet treatment effect, and in which the passage of the fabric is insensitive to holes in the fabric, permits the greatest variety of fabric web widths, and brings about a high level of washing shrinkage effect.

The object is achieved by a method for the continuous wet treatment of textile tubular fabric, characterized in that said fabric, is pre-treated wet and is supplied in strand form. The method comprises the steps of inflating the fabric to form a balloon by means of a gaseous medium; combining the fabric to form a strand; guiding the fabric in strand form through an overflow pipe; and repeating the above steps a plurality of times in analogous sequence.

As a result of the repeated inflation to form a balloon, effected during the treatment process, the treatment fluid therebetween is repeatedly distributed extremely evenly over the fabric which is meanwhile in a fold-free, untwisted state and which, moreover, during each subsequent combining to form a strand consequently automatically achieves the effect of different strand parts repeatedly coming into mutual contact during the subsequent wet treatment in the overflow pipe.

The subject of the invention is, moreover, an apparatus for carrying out the above process.

The invention will be described below with reference to the drawing, in which.

Figure 1:
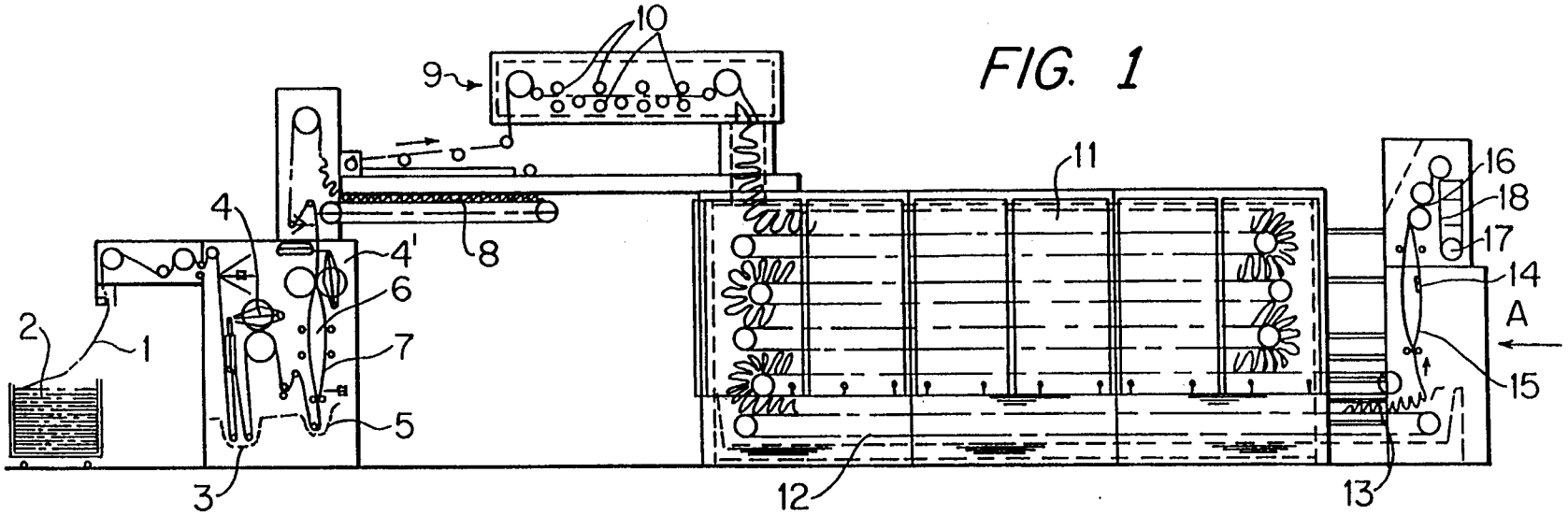
FIG. 1 shows, schematically, a longitudinal section through a part of an embodiment of an apparatus according to the invention for bleaching and washing.

As can be seen from the drawings, the fabric 1 to be treated is drawn off a stack 2, impregnated a first time with the bleaching liquor in the fluid container 3, is then guided through a first open-width squeezing unit 4, and then impregnated a second time with the bleaching liquor in the fluid container 5.

The fabric 1 impregnated thus with the bleaching liquor is then inflated by means of an inflating device 6 to form a balloon 7, so that the impregnating fluid is distributed extremely evenly over the fabric web portion which is in a fold-free state.

Then, the fabric 1 impregnated in this wet manner is supplied through a second open-width squeezing unit 4 to a fabric web store 8 where the fabric 1 dwells for a certain period of time to allow the impregnating fluid to take full effect.

Thereafter, the impregnated fabric 1 is withdrawn in open width from the fabric web store 8 at approximately 100 m/min, and in a heating unit 9 is heated by means of steam nozzles 10 arranged on either side to approximately 95° to 100° C. as it passes through.

Then, the heated fabric 1, still laid out in open-width form, is passed through a steamer unit 11, with a dwell time of for example 30 to 40 minutes and a temperature of approximately 95° to 100° C. and at the outlet of this steamer unit 11 it is also guided continuously through rinsing liquor in the rinsing unit 12 and is then passed into a storage section 13.

The process steps, described below are then repeated many times in analogous manner, the same equipment parts being provided with analogous reference numerals.

For reductive after-treatment, the fabric in open-width form is removed[1] from the storage section 13 is combined to form a strand, then inflated by means of an inflating unit 14 to form a balloon 15, so that the rinsing fluid may be distributed extremely evenly over and in the fabric 1 which is presented in fold-free manner and spread out.

[1] Translator's Note: There is an omission in the German.

Then, if desired, the impregnated, wet fabric 1 may be guided at location 16 through an open-width squeezing unit, containing squeezing rollers, which serve to remove the treatment fabric in open width form after the forming of the fabric into a balloon.

After roller 16, the fabric 1 which passes through at this point in the open-width state is passed into a flushing-in funnel 18 which is in fluid-tight[2] connection with the inlet of the overflow pipe 17, is there combined again to form a strand, and in strand form is passed through the overflow pipe 17 filled with liquor. The length of the overflow pipe 17 in the example illustrated is approximately 9 to 10 meters.

[2] Translator's Note: "flüssigkeitsschichtverbunden"][=in fluid-layer connection] has been assumed to be an error for "flüssigkeitsdichtverbunden" [=in fluid-tight connection] which appears later in the text.

Arranged at the outlet of the overflow pipe 17, for the purpose of draining the liquor out of the fabric 1 which is treated thus, is a fabric store 19 which holds approximately 6 to 8 kg of fabric and is provided with liquor discharge openings, out of which fabric store 19 the liquor passes into the liquor receiving and removing container 20 for further use.

Figure 2:
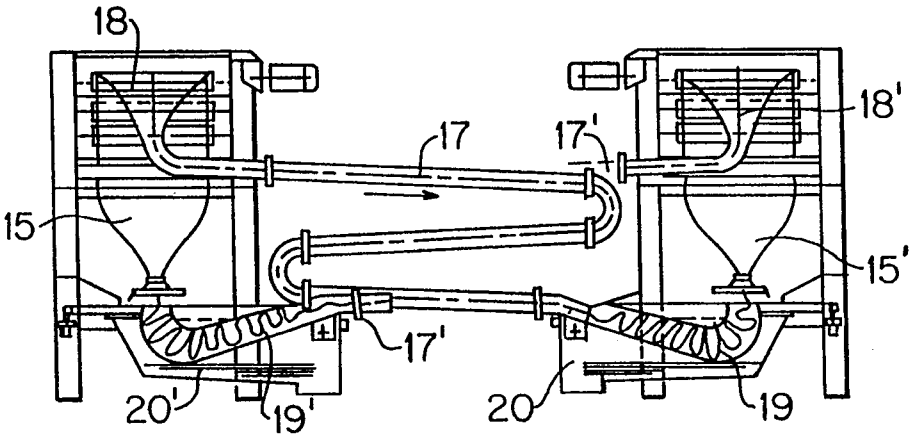
FIG. 2 shows an end view in the direction of the arrow A in FIG. 2.

The fabric 1 to be treated is removed again in the form of a strand from the fabric store 19, inflated to form a balloon 15' by means of an inflating unit 14', so that the rinsing fluid can be distributed again extremely evenly over and in the spread-out fabric 1 which is now again presented in fold-free manner, removed in open width in the open-width state over the roller arrangement located at the point 16', passed into a flushing-in funnel 18' which is in fluid-tight connection with the inlet of the next overflow pipe 17' (not illustrated in FIG. 2 for the sake of clarity), combined again there to form a strand, and in strand form is passed through the overflow pipe 17' filled with liquor.

Arranged at the outlet of the overflow pipe 17', for the purpose of draining the liquor from the fabric 1 which is treated thus, is another fabric store 19' which is provided with liquor discharge openings and out of which the liquor passes into a liquor receiving and removing container 20' for further use.

Figure 3:
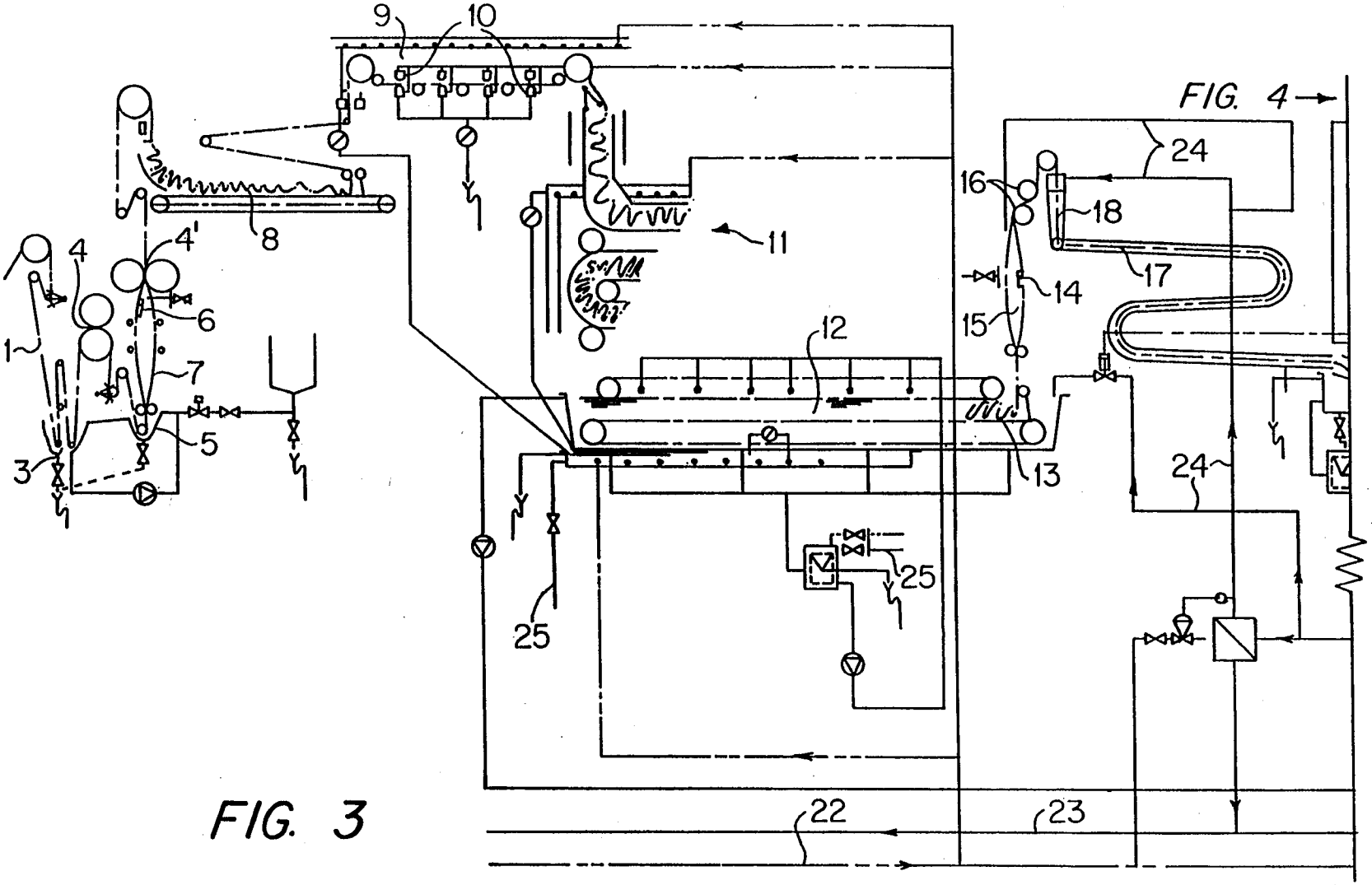
FIG. 3 shows part of the scheme of operation of the apparatus illustrated in FIGS. 1 and 2.
Figures 3, 4:
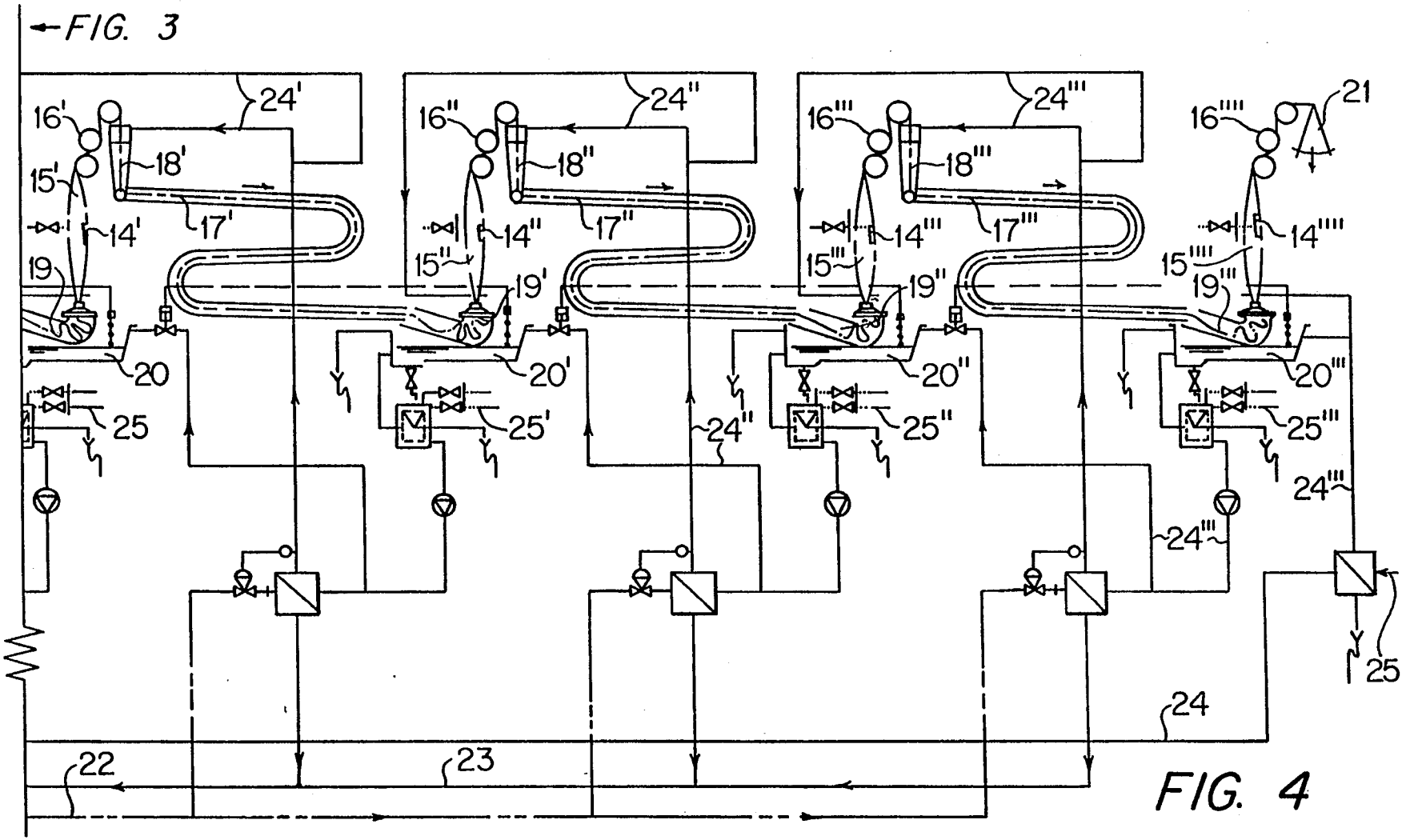
FIG. 4 shows the part of the scheme of operation which adjoins FIG. 3.

These process steps are now repeated a plurality of times, as can be seen in particular in FIGS. 3 and 4.

Fold-free opening, which is repeated a plurality of times, of the fabric to be treated to form a balloon, the subsequent laying out of the fabric in open-width manner, the renewed combining of the fabric 1, which is inevitably different from that carried out previously, to form a strand, the wet treatment thereof, renewed opening of the fabric 1 to form a balloon, etc. effects an extremely intensive wet treatment of the fabric 1 with a minimum of treatment fluid and energy.

As a result of the repeated balloon formation during the washing procedure, a pressing mark which may be made by the roller arrangements 16, 16', 16'' etc is always moved each time to a different location on the tubular fabric 1, so that no pressing mark can still be detected on the end product.

The fabric 1, its treatment complete, emerges from the plant at the point 21 (FIG. 4 ).

The provision of saturated steam to the plant is effected by way of the supply line 22, removal of the condensate is effected by way of the line 23, the liquor circulation is effected by way of the lines 24, and the water supply is effected by way of the supply lines 25.

I claim:

1. An apparatus for the continuous wet treatment of textile tubular fabric, said apparatus comprising:

means for pre-treating said fabric to render said fabric in a wet state and in strand form;

means for inflating said fabric to form a balloon by means of a gaseous medium so that a treatment fluid is evenly distributed over said balloon, and thereby maintaining said fabric in open-width form;

means for returning said fabric to strand form after said fabric has been inflated, said means for returning said fabric to strand form comprises a funnel which is in fluid communication with an inlet side of an overflow pipe, said funnel being disposed directly downstream of said inflating means; and means for passing said fabric in strand form through a liquor located in said overflow pipe and through an outlet side of said overflow pipe.

2. The apparatus according to claim 1, wherein said overflow pipe has a reverse "S" shape and has a downward slope between said inlet side and said outlet side, as seen in a direction of passage of said fabric, and in that overflow pipe has a length of 9 to 10 m between said inlet side and said outlet side.

3. The apparatus according to claim 1, characterized in that there is provided a squeezing unit, which grips said balloon, in open-width form, said squeezing unit provided for the open width squeezing of said fabric and for supplying said fabric to said means for returning said fabric to strand form.

4. The apparatus according to claim 12, wherein said outlet side of said overflow pipe is connected to a storage container provided with liquor removal openings.

* * * * *